US011318633B2

(12) United States Patent
Pandis et al.

(10) Patent No.: US 11,318,633 B2
(45) Date of Patent: May 3, 2022

(54) THINNING OF RAZOR BLADE COATINGS

(71) Applicant: BIC VIOLEX S.A, Anoixi (GR)

(72) Inventors: Christos Pandis, Athens (GR); Konstantinos Mavroidis, Attica (GR); George Kanakaris, Chalandri (GR)

(73) Assignee: BIC VIOLEX S.A., Anoixi (GR)

( * ) Notice: Subject to any disclaimer, the term of this patent is extended or adjusted under 35 U.S.C. 154(b) by 0 days.

(21) Appl. No.: 17/252,061

(22) PCT Filed: Aug. 13, 2019

(86) PCT No.: PCT/EP2019/071670
§ 371 (c)(1),
(2) Date: Dec. 14, 2020

(87) PCT Pub. No.: WO2020/043476
PCT Pub. Date: Mar. 5, 2020

(65) Prior Publication Data

US 2021/0252727 A1 Aug. 19, 2021

(30) Foreign Application Priority Data

Aug. 31, 2018 (EP) ..... 18192034

(51) Int. Cl.

| | |
|---|---|
| ***B26B 21/54*** | (2006.01) |
| ***B05D 3/12*** | (2006.01) |
| ***B26B 21/60*** | (2006.01) |
| ***B05D 3/00*** | (2006.01) |
| ***B05D 5/08*** | (2006.01) |

(52) U.S. Cl.
CPC ..... *B26B 21/60* (2013.01); *B05D 3/007* (2013.01); *B05D 3/12* (2013.01); *B05D 5/083* (2013.01)

(58) Field of Classification Search
CPC ..... B05D 3/12; B26B 21/54; B26B 21/60
See application file for complete search history.

(56) References Cited

U.S. PATENT DOCUMENTS 3,518,110 A * 6/1970 Fischbein ..... B05D 5/083 428/335
5,645,894 A * 7/1997 Trankiem ..... B05D 5/083 427/195

(Continued)

FOREIGN PATENT DOCUMENTS

WO 2017/210290 12/2017

OTHER PUBLICATIONS

International Search Report dated Nov. 8, 2019 in corresponding International PCT Patent Application No. PCT/EP2019/071670, 5 pgs.

(Continued)

*Primary Examiner* — Cachet I Proctor
(74) *Attorney, Agent, or Firm* — Ohlandt, Greeley, Ruggiero and Perle, LLP

(57) ABSTRACT

The invention relates to a method of thinning a coating applied on a razor blade. The method comprises providing a thinning material having a Shore OO hardness in a range of 10-100, more specifically 20-70; contacting the thinning material with an edge of the razor blade, and moving the thinning material relative to the edge of the razor blade such that a shear force is applied on the edge of the razor blade thereby removing at least a portion of the coating applied on the edge of the razor blade.

17 Claims, 4 Drawing Sheets

(56) References Cited

U.S. PATENT DOCUMENTS

| | | | | |
|---|---|---|---|---|
| 5,985,459 | A * | 11/1999 | Kwiecien | B26B 21/60 428/421 |
| 7,247,249 | B2 | 7/2007 | Trankiem | |
| 8,628,821 | B2 | 1/2014 | Wang et al. | |
| 8,889,225 | B2 | 11/2014 | Zhuk et al. | |
| 9,393,588 | B2 | 7/2016 | Vlachos et al. | |
| 2014/0090257 | A1 * | 4/2014 | Wang | B26B 9/00 30/346.5 |
| 2014/0101945 | A1 * | 4/2014 | Wang | C08J 7/00 30/346.53 |
| 2016/0001456 | A1 | 1/2016 | Duff, Jr. et al. | |
| 2016/0096281 | A1 | 4/2016 | Hejmowski et al. | |
| 2016/0096282 | A1 | 4/2016 | Doyle et al. | |

OTHER PUBLICATIONS

Written Opinion dated Nov. 8, 2019 in corresponding International PCT Patent Application No. PCT/EP2019/071670, 7 pgs.

* cited by examiner

THINNING OF RAZOR BLADE COATINGS

CROSS REFERENCE TO RELATED APPLICATION(S)

This application is a National Stage Application of International Application No. PCT/EP2019/071670, filed on Aug. 13, 2019, now published as WO2020043476 and which claims priority from European Application No. EP18192034.9, filed on Aug. 31, 2018, the entire contents of which is incorporated herein by reference.

TECHNICAL FIELD

The present disclosure relates to thinning a coating on a razor blade. In particular, the disclosure relates to thinning a lubricating coating applied on the razor blade. More particular, methods of thinning PTFE coatings applied on razor blades are disclosed.

PRIOR ART

It is typical for razor blades in modern shaving devices to have an outer polymer lubricating coating. Usually, the coating is made of polytetrafluoroethylene (PTFE) because PTFE has been found to be superior in effectively cutting through human hair demonstrating minimal friction on the surface of the skin and pulling on the hair.

It is common to deposit a lubricating coating on blade edge by spraying an aqueous or solvent dispersion of PTFE particles onto the blade and subsequently sintering those particles at temperatures above the melting point of PTFE. This process typically leads to lubricating coatings having a thickness varying from 150 nm to 500 nm. For example, U.S. Pat. No. 9,393,588 discloses a method of forming a lubricating coating on a razor blade that includes: providing a razor blade; providing a tank of a colloidal dispersion of a polymer; providing a spray gun in fluid communication with the tank, the gun having an end directed to a blade-spraying region; placing the razor blade at a predetermined temperature (T) in the blade-spraying region; flowing the colloidal dispersion from the tank to the end of the spray gun, and in a direction to the razor blade; controlling a first gas stream to nebulise the colloidal dispersion into a mist in a dispersion region located between the end of the spray gun and the razor blade; independently controlling a second gas stream to control the mist properties; transporting the mist from the dispersion region to the razor blade placed in the blade-spraying region, the razor blade being at the predetermined temperature (T) so that water evaporates from the mist, and sintering the polymer.

Considering that a very small portion (the first few layers) of the initial PTFE coating chemically adheres to the surface in the above mentioned deposition process, it is still desirable to provide enhanced methods to reduce the thickness of the coatings applied on blades. The rest of the PTFE coating is often described as "excess PTFE" and is removed during the first few strokes of shaving with a new coated blade. This removal of excess PTFE causes some discomfort to the user during the first strokes of a new razor blade. Additionally, it is well known that a thin PTFE coating provides an improved shaving performance compared to a thicker and non-uniform one because a thinner coating leads to lower cutting forces and friction. To address these problems, various methods of PTFE thinning have been suggested.

For example, US 2016/0001456 discloses a method for treating razor blade edges having a first adherent polyfluorocarbon coating with a first solvent to partially remove the polyfluorocarbon coating, adds a second polyfluorocarbon coating, heats, and treats the blade edge with a second solvent providing a final blade edge having a thin, uniform polyfluorocarbon coating.

For example, U.S. Pat. No. 5,985,459 discloses a method for treating conventional razor blade cutting edges having an adherent polyfluorocarbon coating with a solvent to partially remove some of the coating and U.S. Pat. No. 7,247,249 discloses a method for treating razors blade cutting edges having an adherent polyfluorocarbon with a solvent, which partially removes the coating from the razor blade edge. Addition of an antioxidant to the solvent improves the effectiveness of the treatment.

However, the use of solvents and/or heating to thin the PTFE on the blade can lead to degradation of the hardness of the blade and/or reduction in the corrosion resistance properties of the blade. Furthermore, these chemical processes incur a significant impact on the manufacturing cost by increasing the manufacturing complexity and raise environmental issues related to waste management of the solvents involved in these processes.

Thinning methods that do not use solvents have been implemented. For example, US 2016/0096281 discloses a method for shaping a coating on a razor blade, where the step of shaping the applied surface coating on the at least one tip surface to have a second thickness using a centrifuge, which second thickness is less than the first thickness.

For example, US 2016/0096282 details a method for shaping a coating on a razor blade, where the step of shaping the surface coating on the at least one tip surface to have a second thickness using a fluid stream, which second thickness is less than the first thickness.

For example, US 2014/0090257 discloses isostatic-pressing (IP) applied to polymer (e.g., PTFE) coated razor blade edges to produce thin, dense, and uniform blade edges which in turn exhibit low initial cutting forces correlating with a more comfortable shaves.

Deposition methods for applying fluorocarbon coating direct on a blade have been implemented. For example, WO2017210290 discloses a pulsed laser method for depositing a thin, uniform fluorocarbon polymer coating on a multi-faceted substrate, in particular for depositing a thin, substantially uniform film on a cutting edge of a razor blade to reduce friction and lower cutting forces.

It is still desirable to provide razor blades with thinner lubricating coatings or razor blades with thin coatings which at the same time have enhanced corrosion resistance properties and hardness.

SUMMARY

According to aspects of the present disclosure, a method of thinning a lubricating coating applied on a razor blade is provided. The method comprises: providing a thinning material having a Shore OO hardness in a range of 10-100, more specifically 20-70; contacting the thinning material with an edge of the razor blade, and moving the thinning material relative to the edge of the razor blade such that a shear force is applied on the edge of the razor blade thereby removing at least a portion of the lubricating coating applied on the edge of the razor blade.

The provided method is a mechanical method that uses a thinning material, such as a soft thinning material, to remove the excess coating allowing thus a gentle removal of excess lubricating coating, such as PTFE, from the edge of the razor blade. The result is a razor blade that has a thin lubricating coating which causes little or no discomfort to a user. In other words, this process uses a thinning material for applying a force to the edge of the razor blade thereby thinning the coating. This reduces the complexity and cost of manufacturing. Moreover, with the method as herein disclosed, solvents and other abrasive products are no longer required for thinning blade edge coatings thereby enhancing corrosion resistance properties of the razor blade. Additionally, the fact that a mechanical means is used to perform this method is more environmentally conscious. Further, a gentle mechanical process to remove the excess coating is provided by using relative movement between a substantially soft thinning material and the blade edge. Therefore, the damage to the razor blade during the manufacturing process is reduced and thus premature degradation of the razor blade is also reduced.

During the step of moving the thinning material relative to the edge of the razor blade, the razor blade may be maintained at a temperature started from 15° C., specifically in a range of 15 to 330° C., more specifically 15 to 40° C. Maintaining the temperature of the razor blade within the herein disclosed ranges during the thinning process reduces damage to the razor blade during the manufacturing process. In particular, higher temperatures can promote a tempering process thereby reducing the hardness of the razor blade, as well as the corrosion resistance of the razor blades. Thus, maintaining the temperature to be in a range of 15 to 330° C., more specifically 15 to 40° C., prevents premature degradation of the razor blade.

In some examples, the thinning material may be polystyrene foam. Polystyrene foam is known for its soft texture and high fatigue life. When implemented using the disclosed methods, the polystyrene foam can appropriately thin the coating on one or more razor blades.

In some examples, the thinning material may be a mechanical tool selected from a group consisting of a brush-like tool, bristles and a rotary tool.

The step of moving the thinning material relative to the edge of the razor blade may include, for example, moving the thinning material in a first direction that is parallel to the edge of the razor blade. This movement results in a shear force being applied to the outer surface of the coating and allows for the excess coating to be removed.

In some examples, the razor blade and the thinning material may move relative to each other at a speed in a range of 0.003-0.3 m/s. This speed facilitates efficient thinning of the coating on a razor blade, or on a plurality of razor blades, which is beneficial, for example, in a bulk manufacturing setting.

These methods may be repeated until the thickness of the coating on the edge of the razor blade is in a range of 1-50 nm. This process may be iterative to precisely thin the coating on a razor blade so that the thickness of the coating is uniform or substantially uniform. Additionally, the thinning material may be configured to remove an amount of the excess of the coating from the edge, either thoroughly at once or partially each time the method is executed.

In some examples, the thinning material may contact respective edges of a plurality of razor blades and the movement of the thinning material relative to the respective edges of the plurality of razor blades may be accomplished. This process may efficiently thin a plurality of razor blades, for example, in a bulk manufacturing setting.

In some examples, the thickness of the thinning material is in a range of 1-50 mm. The thickness of the material may be related to the amount of force applied on the blade edge and may thus provide a gentle thinning process avoiding, or at least reducing, premature degradation of the blade.

In some examples, the method may further comprise contacting the thinning material with the edge of the razor blade which comprises inserting the edge of the razor blade at least partially into the thinning material. This way coating on adjacent facets of the blade edge can be removed simultaneously and therefore provide an efficient manufacturing process.

In some examples, the thinning material may be configured to be cut by the blade edge when the blade edge is inserted therein. Having the blade cut into the thinning material rather than, for example, provide a precut thinning material, reduces the time needed to thin the coating on the razor blades and/or the manufacturing costs.

In some examples, the blade edge may be configured to be inserted into the thinning material up to 2 mm.

In some examples, moving the thinning material relative to the edge of the razor blade may comprise arranging the blade edge and the thinning material to be angled relative to each other. Angled relative to each other should be understood as arranging the thinning material and the blade with an angle between them. Particularly, the angle between the thinning material and the blade edge may be between 0.5° and 90°.

In some examples, moving the thinning material relative to the edge of the razor blade comprises a back-and-forth motion, a circular motion or a swiveling motion.

In some examples, contacting the thinning material with an edge of the razor blade comprises contacting the thinning material with at least one facet of the blade edge.

In some examples, the lubricating coating applied on the razor blade may be polyfluorocarbon, more specifically polytetrafluoroethylene (PTFE).

In some examples, a razor blade may be obtained by the herein disclosed method. The edge of the razor blade may have a substantially uniform lubricating coating thickness in a range from 1-50 nm. Particularly, blades having a lubricating thickness in a range from 10-20 nm may be foreseen.

The above summary is not intended to describe each and every implementation of the present disclosure. In particular, selected features of any illustrative example within this disclosure may be incorporated into additional examples unless clearly stated to the contrary.

BRIEF DESCRIPTION OF THE DRAWINGS

The disclosure may be more completely understood in consideration of the following detailed description of non-limiting aspects of the disclosure in connection with the accompanying drawings, in which.

While aspects of the disclosure are amenable to various modifications and alternative forms, specifics thereof have been shown by way of example in the figures and will be described in detail. It should be understood, however, that the intention is not to limit aspects of the disclosure to the particular example described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the figures. The detailed description and the figures, which are not necessarily to scale, depict illustrative aspects and are not intended to limit the scope of the invention. The illustrative aspects depicted are intended only as exemplary.

Figure 1:
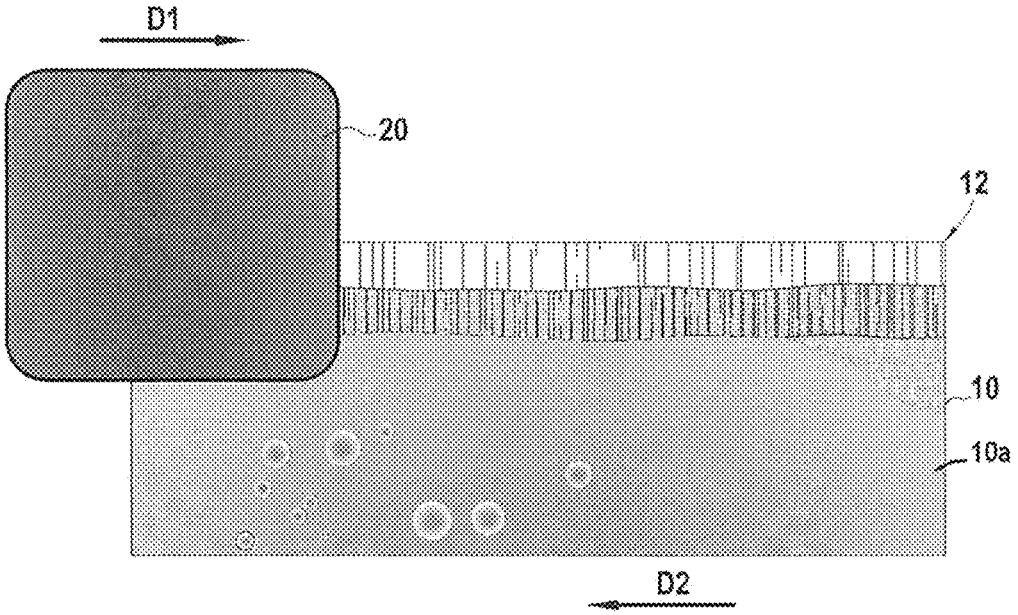
FIG. 1 is a schematic view of a razor blade and a thinning material.

FIG. 1 is a schematic view of a razor blade 10 having a blade edge 12 and a lubricating coating. The razor blade 10 may have a top surface 10*a* and an opposing bottom surface (not shown). The deposition of the lubricating coating on blade edge 12 may be performed by chemical vapor deposition, laser deposition, sputtering deposition, or nebulization process. Alternatively, the deposition may be performed by dipping, brushing, or spraying. Other ways of applying a lubricating coating on a blade edge may also be foreseen.

Aspects of the present disclosure provide for a process for thinning the already formed lubricating coatings. In some examples, the lubricating coating applied on the razor blade 10 may be polyfluorocarbon, more specifically polytetrafluoroethylene (PTFE). In some examples, the methods as herein disclosed may be performed on the razor blade 10 when the razor blade 10 is maintained at a temperature in the range 15-330° C.

In examples, the blade edge 12 may be inserted into a "soft" thinning material 20. The thinning material 20 may have a Shore OO hardness in a range of 10-100, more specifically 20-70. In some examples, the methods as herein disclosed comprise contacting the thinning material 20 with an edge 12 of the razor blade 10, and moving the thinning material 20 relative to the edge 12 of the razor blade 10 such that a shear force is applied on the edge 12 of the razor blade 10. This results in removing at least a portion of the coating applied on the edge 12 of the razor blade 10.

In some examples, the thinning material 20 may be in the form of a monoblock component. Examples of monoblock components may comprise rubber, cork, felt, cotton textile, soft polymer or a foamy polymer, for example, polystyrene foam (chemical formula (C8H8)n). In some examples, the thinning material 20 may be formed as a rectangular prism. In some examples, the thinning material 20 may have a thickness within a range of 1-50 mm. In alternatives, the thinning material 20 may have any other shape or configuration.

In some embodiments, the thinning material 20 may be configured as a mechanical tool, such as a brush-like tool or a bristle or any other two-component tool, such as a rotary tool comprising a shaft as a base and a contacting surface made of felt, flannel, cotton, leather, composite or other material typically used for polishing, buffing, grinding or other material processing. Combinations of the mechanical tool with the herein disclosed monoblock components may also be foreseen.

In some examples, contacting the thinning material 20 with an edge 12 of the razor blade 10 may comprise contacting the thinning material 20 with respective edges 12 of a plurality of razor blades 10 and the movement of the thinning material relative to the respective edges 12 of the plurality of razor blades 10 may be accomplished.

In some examples, the methods comprise contacting the thinning material 20 with the edge 12 of the razor blade 10 by inserting the edge 12 of the razor blade 10 at least partially into the thinning material 20. In still more examples in which the razor blade 10 may be inserted into the thinning material 20, the blade edge 12 may itself cut the thinning material 20, thus wedging adjacent facets of the blade edge 12 of the razor blade 10 into the thinning material 20. In these examples, the razor blade 10 may be configured to be inserted into the thinning material up to 2 mm. In examples, the blade 10 may be configured to be inserted into the thinning material 20 from at least 5 μm, to substantially cover the blade edge. Thereafter, the blade edge 12 may be sheared with the thinning material 20. Alternatively, the thinning material 20 may be positioned to simply contact the adjacent facets, and thereafter, the blade edge 12 may be sheared with the thinning material 20. In some examples, contacting the thinning material 20 with an edge 12 of the razor blade 10 may comprise contacting the thinning material 20 with at least one facet of the blade edge 12.

In some examples, moving the thinning material 20 relative to the edge 12 of the razor blade 10 may include moving the thinning material 20 in a first direction D1 that may be parallel to the blade edge 12, as shown in FIG. 1. During this movement of the thinning material 20 in the first direction D1, the razor blade 10 may be stationary such that only the thinning material 20 moves. In alternatives, the thinning material 20 may be stationary and only the razor blade 10 may be moved along the first direction D1. In still more examples, the thinning material 20 and the razor blade 10 may be moved relative to each other. In some examples, the thinning material 20 and/or the blade edge 12 may move only in a single direction. In others, the thinning material 20 and/or the blade edge 12 may move in a first direction D1 and then in a second direction D2 that is opposite from the first direction D1, e.g., in a back-and-forth motion. In others, the thinning material 20 may be moved relative to the blade edge 12 in a circular or swiveling motion. In other examples, the thinning material 20 and/or the blade edge 12 may move relative to each other in non-parallel directions. The thinning material 20 and the blade edge 12 may move with respect to each other at an angle between 0.5° and 90°. In some examples, moving the thinning material 20 relative to the edge 12 of the razor blade 10 may comprise arranging the blade edge 12 and the thinning material 20 to be angled relative to each other.

Throughout the present description and claims, the term "shearing away" is intended to mean applying a shear stress/force to the lubricating coating on the razor blade. Shear stress/force is the application of a frictional force parallel to co-planar cross-sectional areas of the coating. In a manufacturing setting, the thinning approach allows for an in line process application without transferring the finished blade(s) to a separate manufacturing station.

In some examples, the thinning process may be performed until the thickness of the coating is approximately 1-50 nm. In some examples, the thinning process may be repeated until the thickness of the coating applied on the edge 12 of the razor blade 10 is in a range of 1-50 nm. In some examples, the force applied by the thinning material may be within a range of 0.1-100N. The application of a steady force throughout the thinning process allows for a gentle thinning process that avoids or at least reduces premature degradation of the blade 10. The value/magnitude of the force applied on the blade edge 12 affects the amount of coating that is removed. In some examples, the razor blade 10 and the thinning material 20 may be moved relative to each other at a speed within a range of 0.003-0.3 m/s.

Thinning processes as herein disclosed allows for the removal of any excess coating, leaving only a thin layer of the coating which is well adhered to the edge 12 of the razor blade 10. In some examples, a razor blade 10 may be obtained by the herein disclosed processes, where the edge 12 of the razor blade 10 may have a lubricating coating having thickness in a range from 1-50 nm. Furthermore, the thinning process as herein disclosed is a soft thinning process thereby thinning the lubricating coating such that it is not visible under an optical microscope.

Figure 2A:
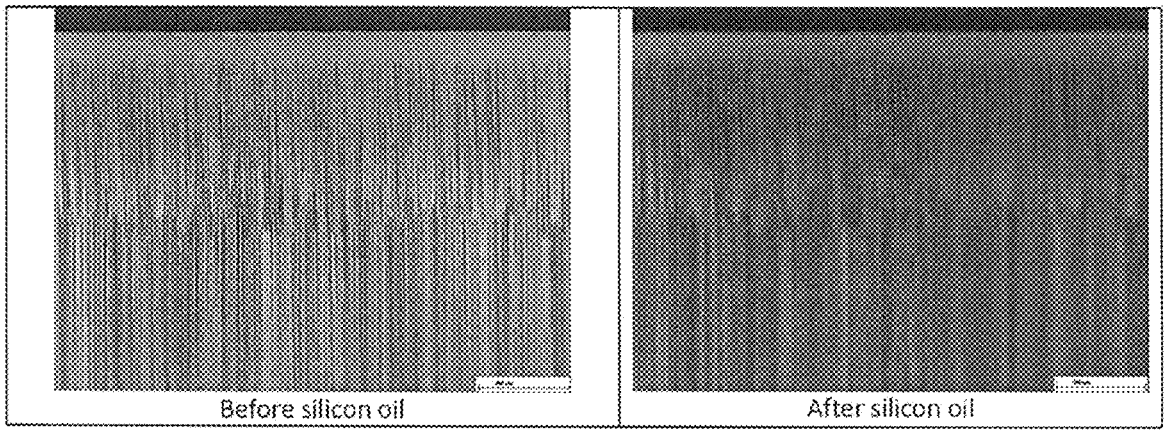
FIG. 2A is an image showing an uncoated razor blade before and after performing the silicon oil method.
Figure 2B:
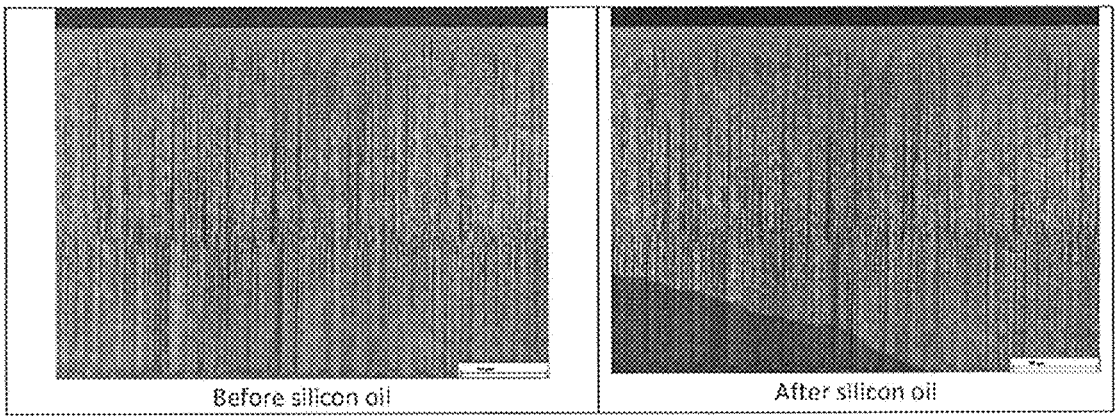
FIG. 2B is an image showing a razor blade having a PTFE coating that has not been thinned, before and after performing the silicon oil method.
Figure 2C:
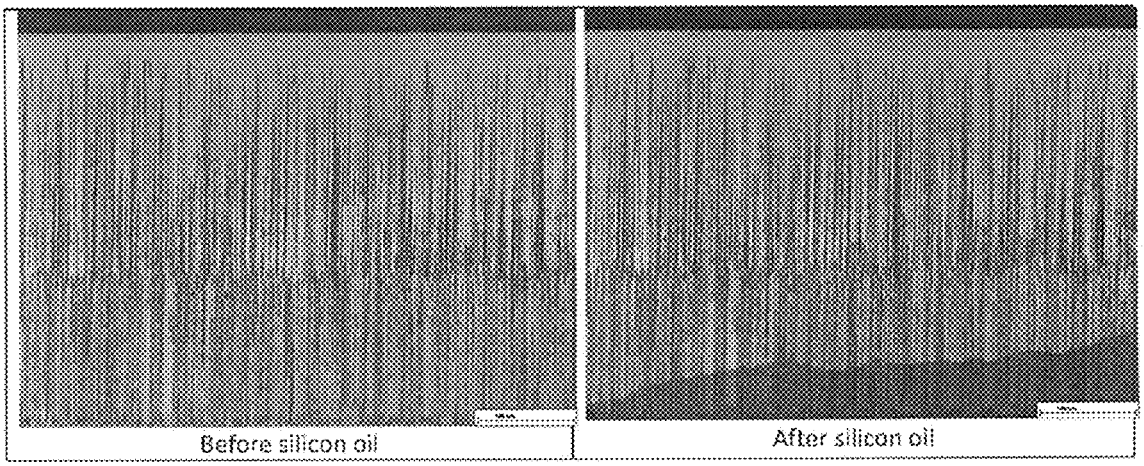
FIG. 2C is an image showing a razor blade having a PTFE coating that has been thinned using the disclosed method, before and after performing the silicon oil method.

This is shown in FIGS. 2A-2C. Usually, a silicon oil method is used to confirm the presence of PTFE coating. FIG. 2A shows images of an uncoated razor blade before and after performing the silicon oil method. FIG. 2B shows images of a razor blade with a PTFE coating where the coating has not been thinned, i.e. an untreated blade, before and after performing the silicon oil method. FIG. 2C shows images of a razor blade (with a PTFE coating where the coating has been thinned using the disclosed thinning methods, i.e. a treated razor blade, before and after performing the silicon oil method. In some examples, as shown in FIG. 2A, silicon oil fully wets an uncoated razor blade, whereas as shown in FIG. 2B, silicon oil is repelled from a razor blade having an initial PTFE coating. As shown in FIG. 2C, silicon oil is repelled from a razor blade after thinning which is an indication of its presence even if it could not be observed under optical microscope.

A comparison of the images of the uncoated razor blade of FIG. 2A and the treated razor blade shown in FIG. 2C shows that the surfaces appear similar. However, the image of the untreated razor blade shown in FIG. 2B is different and shows the surface having a blotchy appearance. These blotches show the excess PTFE material on the razor blade. Additionally, as can be seen in comparing FIGS. 2A and 2C, the blade edge has not been damaged by the mechanical thinning process, as there is no indication of blade edge damage after the removal of excess of PTFE using the described method.

Figure 3A:
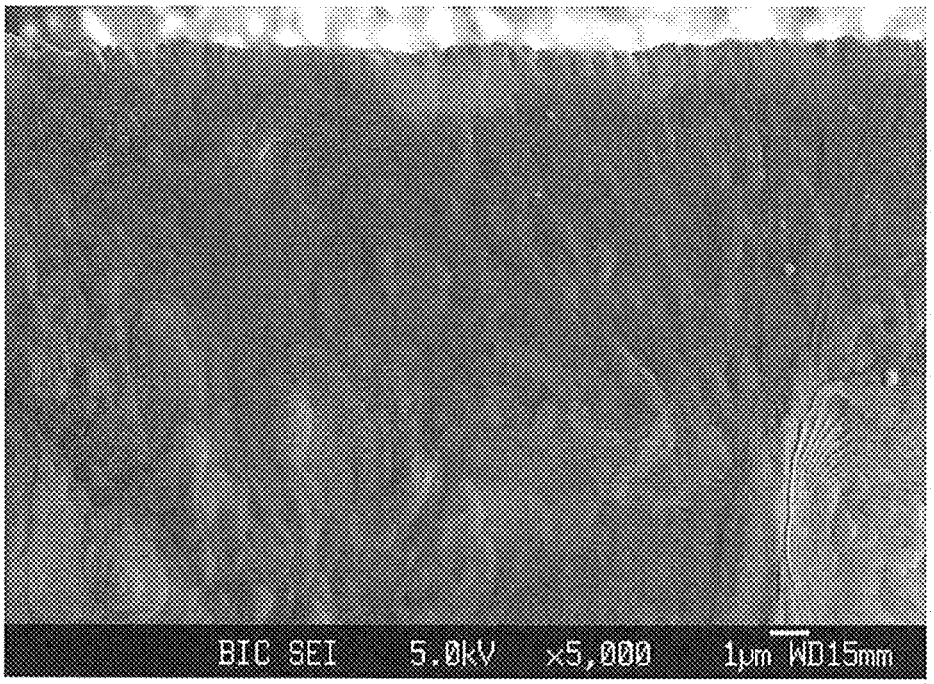
FIG. 3A is an image showing an SEM micrograph at 5000× magnification on a razor blade having a PTFE coating that has not been thinned.
Figure 3B:
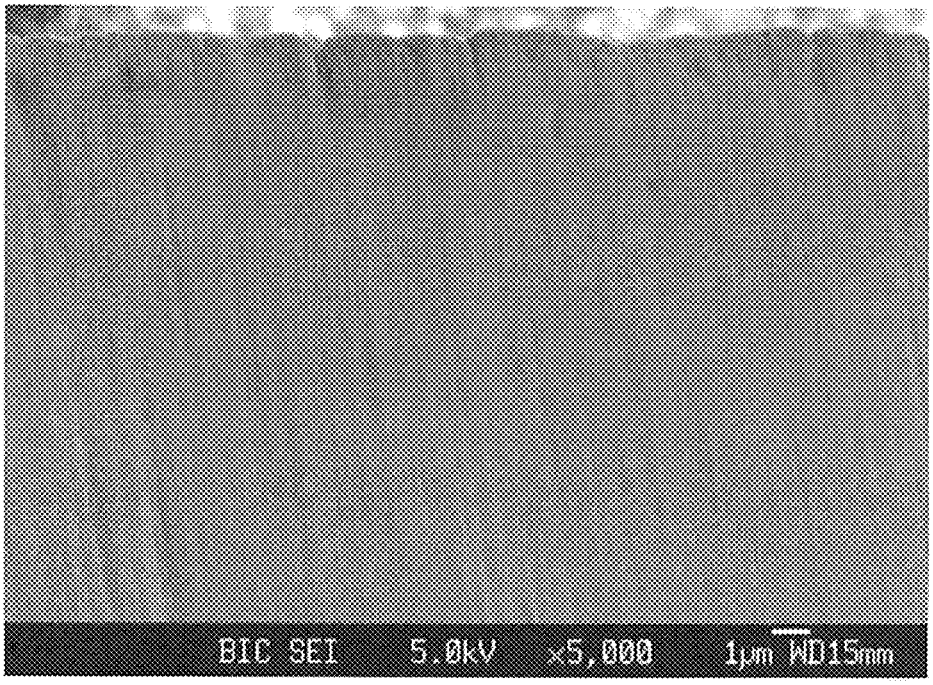
FIG. 3B is an image showing an SEM micrograph at 5000× magnification on a razor blade having a PTFE coating that has been thinned using the disclosed method.

The examples of FIGS. 3A and 3B show images of a SEM micrograph at 5000× magnification on a razor blade having a PTFE coating. FIG. 3A shows the razor that has not been thinned, i.e. an untreated razor blade and FIG. 3B shows a razor blade having a PTFE coating that has been thinned, i.e. a treated razor blade. As can be seen in FIG. 3A, the untreated razor blade shows the excess PTFE as having an uneven and layered surface, whereas FIG. 3B shows the treated razor blade as having a more uniform surface. This substantially uniform surface avoids or at least reduces the discomfort to a user when they use the razor blade.

Figure 4:
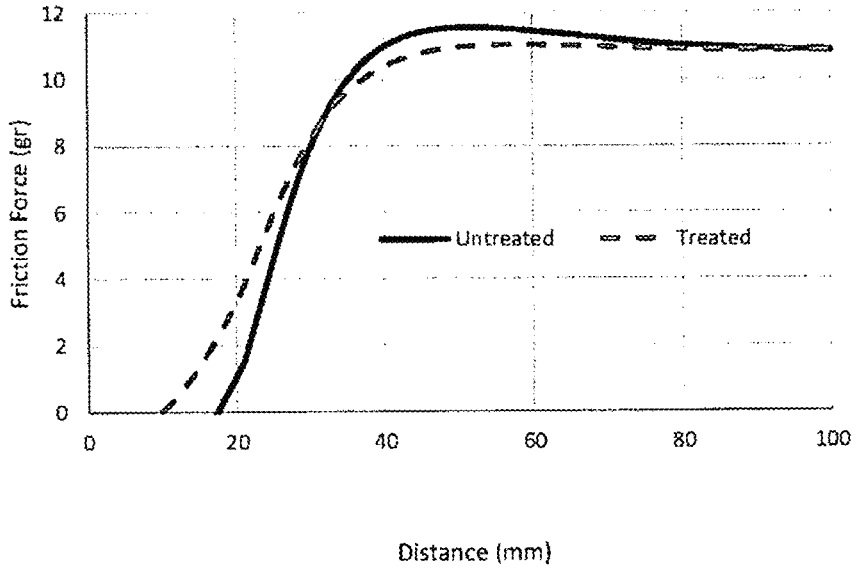
FIG. 4 is a graph showing a comparison of the friction force of a razor blade that has a PTFE coating that has not been thinned and a friction force of a PTFE coating that has been thinned according to the disclosed method.

FIG. 4 is a graph showing the comparison of the friction force of an untreated razor blade and a treated razor blade. As can be seen, as the distance increases, the frictional force (gr) of the untreated razor blade gets higher than the treated razor blade as measured by a Friction Test.

In the Friction Test, the friction force between the blade edge and paper is measured when one facet of the blade edge slides over a paper ribbon. The blade-sample is placed on an appropriate blade mounting base such that only one facet of the razor blade is in contact with and is parallel to the paper. During the measurement, while the paper is moving with a specific speed and for a determined distance, friction forces are developed which are detected by a load cell and recorded through a program. The obtained data can thus be plotted on a graph of Friction force (gr) vs distance (mm) as that shown in the example of FIG. 4.

Figure 5:
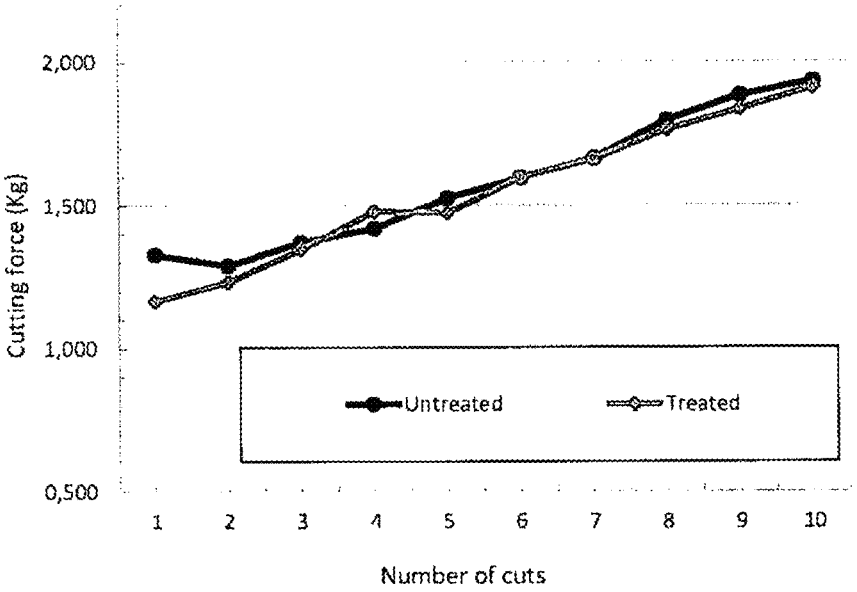
FIG. 5 is a graph showing a comparison of the cutting force of an untreated razor blade and a treated razor blade.

FIG. 5 is a graph showing the comparison of the cutting force of an untreated razor blade and a treated razor blade measured by a cutting force test. The cutting force test involves repeating cutting action of the razor blade on a moving felt, using a load cell for measuring the load on the razor blade for a series of 10 cuts. The graph shows that the treated razor blade presents a lower cutting force at least for the initial cuts.

Throughout the present description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A method of thinning a lubricating coating applied on a razor blade, the method comprising: providing a thinning material having a Shore OO hardness in a range of 10-100, contacting the thinning material with an edge of the razor blade, and moving the thinning material relative to the edge of the razor blade so that a shear force is applied on the edge of the razor blade thereby removing at least a portion of the lubricating coating applied on the edge of the razor blade.

2. The method according to claim 1, wherein the thinning material has a Shore OO hardness in a range of 20-70.

3. The method according to claim 1, wherein during the step of moving the thinning material relative to the edge of the razor blade, the razor blade is maintained at a temperature in a range of 15 to 330° C.

4. The method according to claim 1, wherein during the step of moving the thinning material relative to the edge of the razor blade, the razor blade is maintained at a temperature in a range of 15–40° C.

5. The method according to claim 1, wherein the thinning material is polystyrene foam.

6. The method according to claim 1, wherein the thinning material is a mechanical tool selected from the group consisting of a brush-like tool, bristles and a rotary tool.

7. The method according to claim 1, wherein the step of moving the thinning material relative to the edge of the razor blade includes moving the thinning material in a first direction that is parallel to the edge of the razor blade.

8. The method according to claim 7, wherein the step of moving the thinning material relative to the edge of the razor blade further includes moving the razor blade and the thinning material relative to each other at a speed in a range of 0.003-0.3 m/s.

9. The method according to claim 1, wherein the step of contacting the thinning material with an edge of the razor blade comprises contacting the thinning material with respective edges of a plurality of razor blades.

10. The method according to claim 1, wherein the thickness of the thinning material is in a range of 1-50 mm.

11. The method according to claim 1, wherein contacting the thinning material with an edge of the razor blade comprises inserting the edge of the razor blade at least partially into the thinning material.

12. The method according to claim 11, wherein the blade edge is inserted into the thinning material up to 2 mm.

13. The method according to claim 11, wherein during the step of moving the thinning material relative to the edge of the razor blade, the blade edge and the thinning material are arranged to have an angle of between 0.5 degrees and 90 degrees relative to each other.

14. The method according to claim 1, wherein moving the thinning material relative to the edge of the razor blade comprises a back-and-forth motion, a circular motion or a swiveling motion.

15. The method according to claim 1, wherein contacting the thinning material with the edge of the razor blade comprises contacting the thinning material with at least one facet of the blade edge.

16. The method according to claim 1, wherein the lubricating coating applied on the razor blade is polyfluorocarbon.

17. The method according to claim 1, wherein the lubricating coating applied on the razor blade is polytetrafluoroethylene.

* * * * *